US006442904B1

(12) United States Patent
Ortiz

(10) Patent No.: US 6,442,904 B1
(45) Date of Patent: Sep. 3, 2002

(54) NON-PONDING FLAT ROOF EDGING

(76) Inventor: A. Jerry Ortiz, P.O. Box 293748, Sacramento, CA (US) 95829

( * ) Notice: Subject to any disclaimer, the term of this patent is extended or adjusted under 35 U.S.C. 154(b) by 0 days.

(21) Appl. No.: 09/598,203

(22) Filed: Jun. 21, 2000

(51) Int. Cl.[7] ..... E04D 13/00
(52) U.S. Cl. ..... 52/11; 52/410; 52/96; 52/94; 52/60
(58) Field of Search ..... 52/543, 547, 556, 52/549, 11, 15

(56) References Cited

U.S. PATENT DOCUMENTS 4,077,171 A * 3/1978 Simpson et al. ..... 52/96
4,557,081 A * 12/1985 Kelly ..... 52/94
5,031,367 A * 7/1991 Butzen ..... 52/60
5,031,374 A * 7/1991 Batch et al. ..... 52/410

* cited by examiner

*Primary Examiner*—Carl D. Friedman
*Assistant Examiner*—Steve Varnet
(74) *Attorney, Agent, or Firm*—Mark C. Jacobs

(57) ABSTRACT

A replacement edging for gravel stop edging for use on flat roof buildings is disclosed. The unit features an inverted L-shaped, the terminal area of the vertical section thereof being bent and formed around to retain the edge of an overlaid layer of APR, attactic polypropylene rubber. During the roof construction process, the balance of the APR is torched into place onto the metal member. The rest of the roof construction process is otherwise conventional. The process of on site application of the new edging is also disclosed.

10 Claims, 4 Drawing Sheets

NON-PONDING FLAT ROOF EDGING

FIELD OF THE INVENTION

BACKGROUND OF THE INVENTION

This invention relates to the edging used at the interface between the roof and the vertical top edge of a building. Prior to this invention, a roof edging would be employed for flat roof building that was configured as an upstanding member, that was approximately 2 inches tall. This upstanding member is formed of sheet metal as a vertical member curved at the top and bent to form a hard 90 degree angle to provide a surface for the nailing to the roof. A section of the vertical portion stands upright to prevent water from flowing over the edge of the roof. As is known in the art, flat roof buildings are meant to be able to withhold a certain amount of water. This ability called ponding, can create stress to the roof and its supporting members if too much water is permitted to accumulate.

The purpose of the present invention is to replace the prior art basically upstanding member, and to alleviate the ponding on flat roof buildings. The present invention also permits the water to be carried away in a gutter system for transportation for either reuse or disposal.

It is an object therefore of this invention to provide a non-ponding flat roof edging.

It is another object to provide a roof edging that permits water to be removed from the roof for disposal.

It is still another object to provide a roof edging that does not come loose from the edge of the building as can happen sometimes with the prior art edging.

It is yet another object to provide a roof edging that is as easy to install as the metal gravel stop previously employed.

It is a yet further object to provide a process for the manufacture and installation of the non-ponding roof edging of this invention.

Other objects of the invention will in part be obvious and will in part appear hereinafter.

The invention accordingly comprises the device possessing the features properties and the relation of components which are exemplified in the following detailed disclosure and the scope of the application of which will be indicated in the appended claims.

For a fuller understanding of the nature and objects of the invention reference should be made to the following detailed description, taken in conjunction with the accompanying drawings.

SUMMARY OF THE INVENTION

A replacement edging for metal gravel stop for use on flat roof buildings. The edging comprises an inverted L-shaped metal wherein, the horizontal section is of larger extension than the vertical section. To this inverted L-shaped section is attached a layer of APR which stands for Attactic polypropylene rubber. The attachment is carried out by bending outwardly a flange portion which depends downwardly from the vertical section, upward and over the APR to retain the edge of the APR sheet. The flange portion extends the entire length of the vertical section, but for a short finite distance and is contiguous with the vertical section. The APR may extend anywhere from about 2 to about 4 inches behind the horizontal surface 23 of the metal unit 22 to provide for adequate overlap onto the membrane. Later in time during the roofing process the APR is torched down to retain it in place. Cap sheet is applied in conventional fashion over the non-ponding edging of this invention. The process of installing the new edging is also disclosed.

The invention also covers the process pertaining to the formation and installation of the non-ponding edging.

DESCRIPTION OF THE PREFERRED EMBODIMENT

Figure 1:
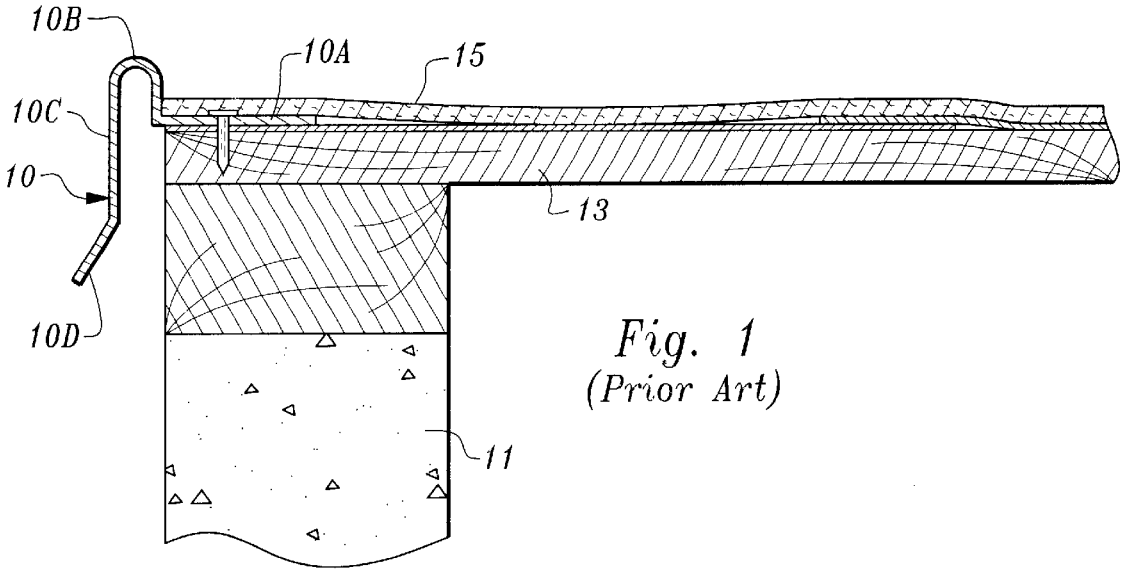
Fig. 1 (Prior Art)
FIG. 1 is a prior art gravel stop edging used on flat room buildings shown in a diagrammatic drawing.

In FIG. 1, the conventional metal gravel stop that has been used for many many years as the edging for flat roofed buildings is shown in a sectional diagrammatic view. Brick, cinder block or tilt up wall 11 is connected to a plywood sub-roof layer 13 by conventional means. The formed metal prior art edging 10 is nailed or otherwise applied through its horizontal section 10A, to the plywood as the first step in the roof addition process.

The term formed metal is used as one sheet of metal is bent in several locations such as in a metal brake to form the prior art device. Galvanized steel is preferred for the metal member due to price.

Prior art unit 10 includes a first horizontal section 10A, connected at a right angle to an inverted U-shaped section 10B, which section 10B is the upstanding water retaining member. Section 10B is in turn connected to a contiguous straight vertical section 10C, which in turn is connected to an outwardly extending terminal section 10D. See FIG. 1.

Figure 2:
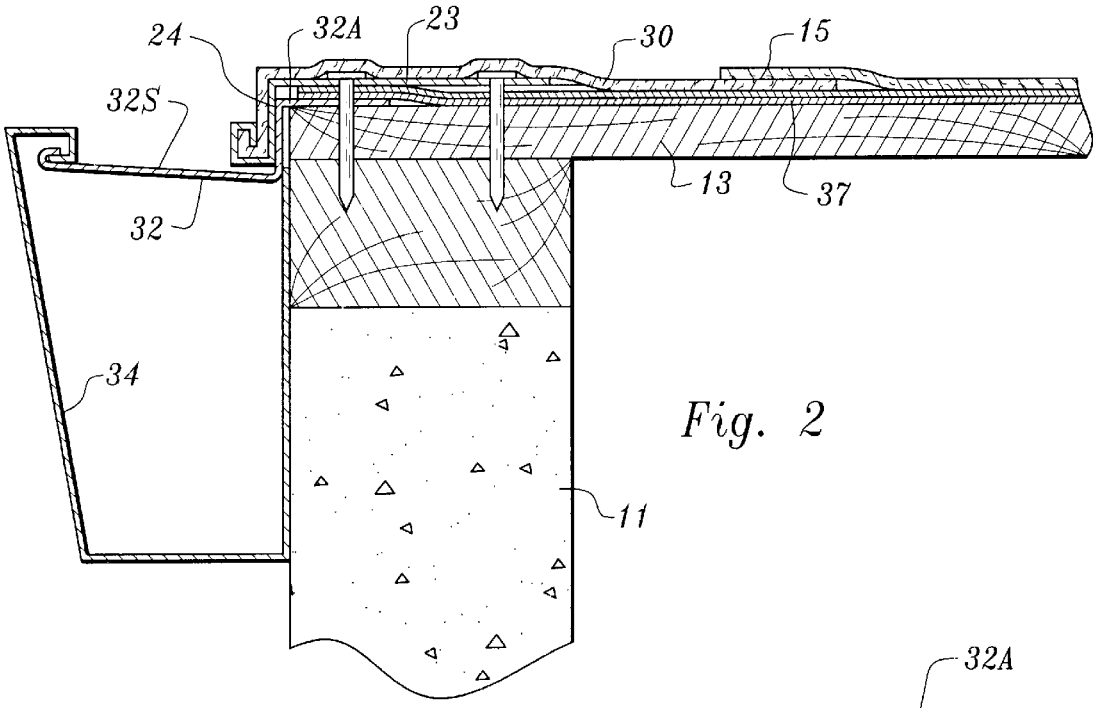
FIG. 2 is a diagrammatic sectional view of a building with the invention of this application shown installed.

The invention of this application is also shown in an installed condition in the sectional diagrammatic drawing of FIG. 2. The actual unit is shown in top perspective in FIG. 4 and in bottom perspective in FIG. 5.

Figure 3:
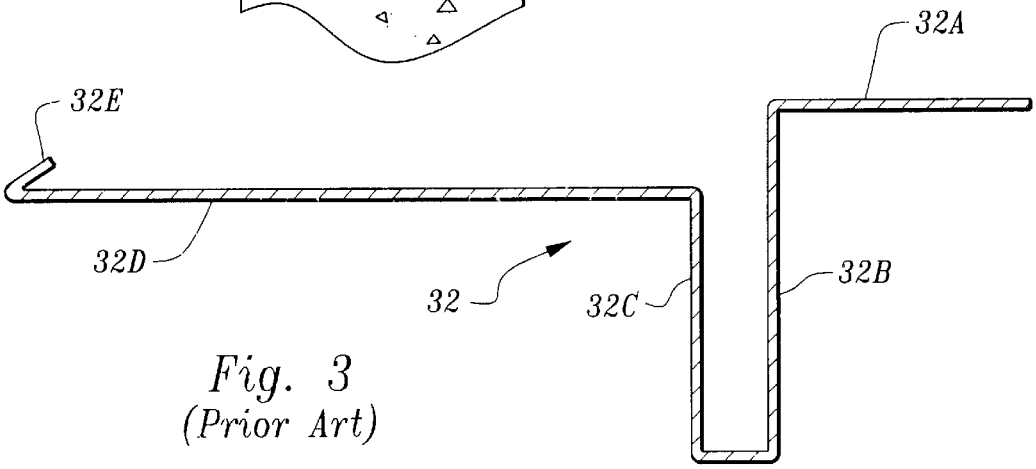
Fig. 3 (Prior Art)
FIG. 3 is a sectional view of a gutter strap that is used in conjunction with this invention.

Prior to the discussion of FIG. 2, the reader's attention is drawn to FIG. 3. Here conventional gutter straps 32 are seen. These straps are manufactured by various companies and are used for the mounting of conventional rain water removing gutters to flat roof buildings. These gutter straps include a first horizontal section 32A, connected to a downwardly depending L-shaped second section 32B, whose terminus is connected to a vertical upstanding section of shorter elevation that the vertical part of the L-shaped section, and whose terminus is connected to a horizontal outwardly extending section 32D, having a terminal hook section 32E thereon.

Reference is now made to FIG. 2. Again wall 11 has a layer of plywood 13 connected thereto in conventional building forming manner. A gutter strap 32s horizontal section 32A is nailed or otherwise secured to the plywood layer 23. (It is to be understood that the gutter straps are placed 5 to 8 feet or more apart as hew job calls for.) Thus at every sectional location, one more than likely will not see a gutter strap.

After the series of gutter straps 32 are attached to the plywood sub-roof 13, a membrane, 37, of 2 or more plies which serves as a water barrier is overlaid onto the plywood and over the gutter straps 32 when present. Next, the metal portion 22 of the device 20 of this invention is attached through the membrane to the plywood sub-roof as by nails 23, after one holds aside the APR layer 23, which as can be seen in FIG. 3 overlays the metal portion 22.

The overlaid APR 30, already retained in the metal portion 22, is torched down—a term known to the roofing art—followed by the application of the multiple layers of cap sheet 15, also by torching down or other conventional mode.

Figure 4:
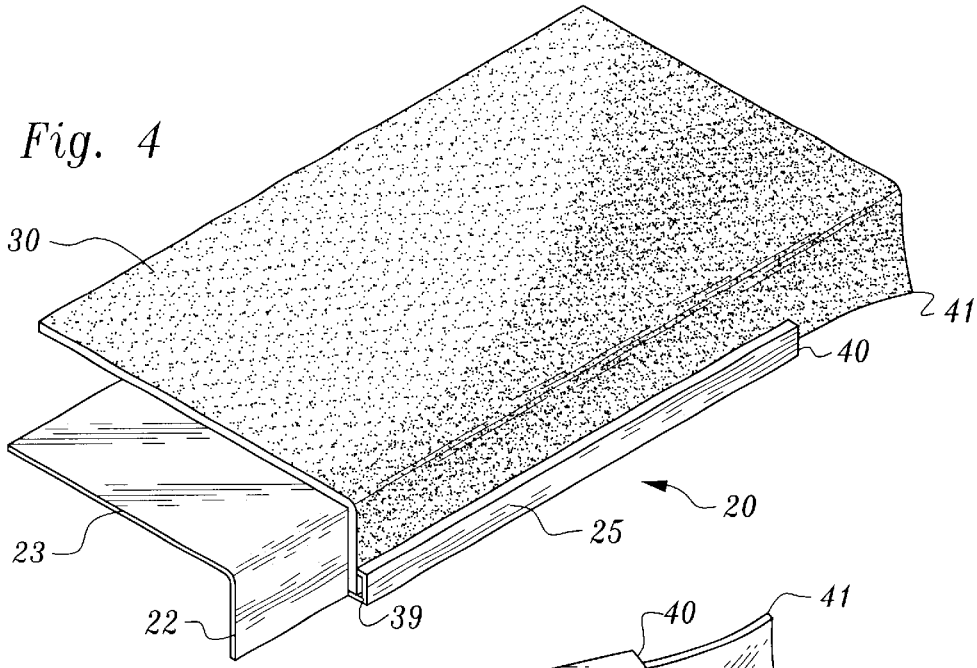
FIG. 4 is a top perspective view of one section of the non ponding flat roof edging of this invention.
Figure 5:
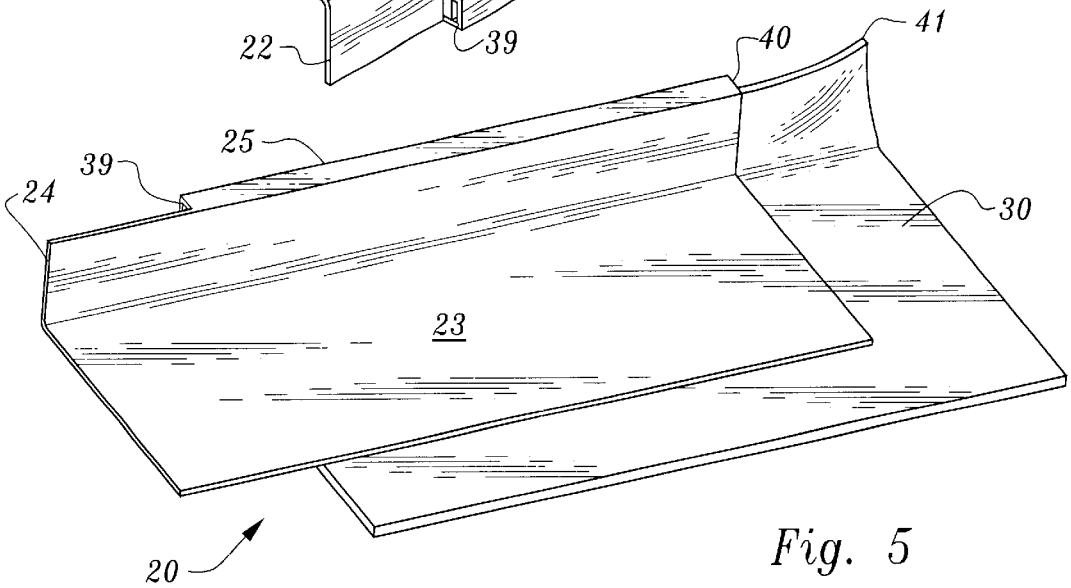
FIG. 5 is a bottom perspective view of the device of FIG. 4.

In the discussion of FIGS. 4 and 5 the details of the invention of this application will be recited. In FIG. 4, device 20 is seen in abbreviated length. Preferably the units are made in 2 to 4 foot lengths for ease of use, while the one shown in the drawing is about 1 foot in length and is less preferred. As noted earlier device 20 has a first horizontal section 23 and a second vertical section 24, and a downwardly dependent flange 25 which is formed in the manner described with respect to FIGS. 7 and 8. The reader's attention is drawn to the fact that the APR is secured in the flange and that the flange portion extends from the point of commencement of overlap 39, during installation as can be seen by reference to FIG. 6. Point 39 is seen to be approximately 2 inches from the edge of the metal member 22. The amount of overlap of the APR onto the next unit of the invention is equal to the distance between point 40, the end of the metal fold, and point 41, the end of the APR sheet, a distance usually of about 3 inches. See also FIG. 6 the bottom perspective view, for these reference points. The depth of the horizontal section of unit 20 may be preferably about 6 inches, though more or less is operable; while the length is preferably about 4 feet.

Figure 6:
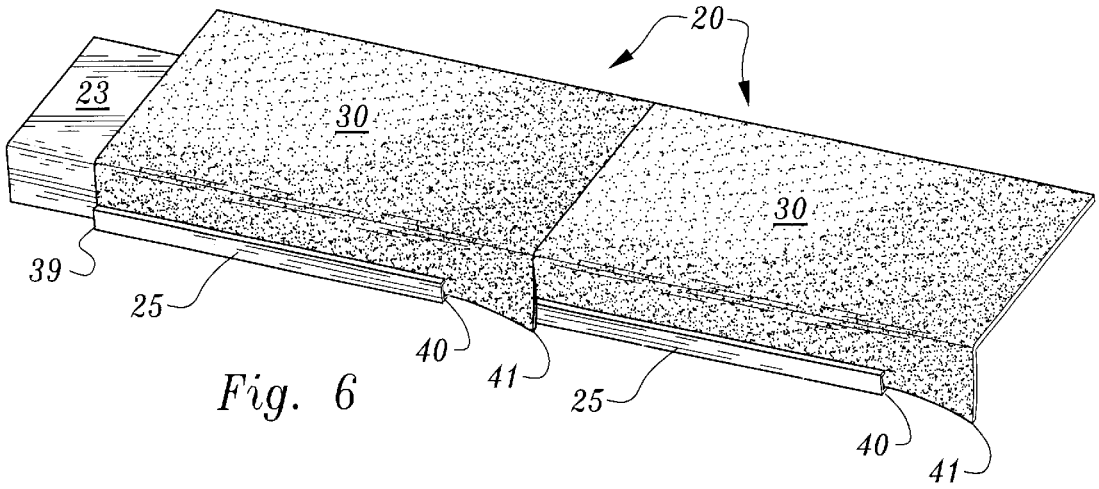
FIG. 6 is a top perspective view of two of the edging units of this invention shown in an overlapped as installed relationship.
Figure 7:
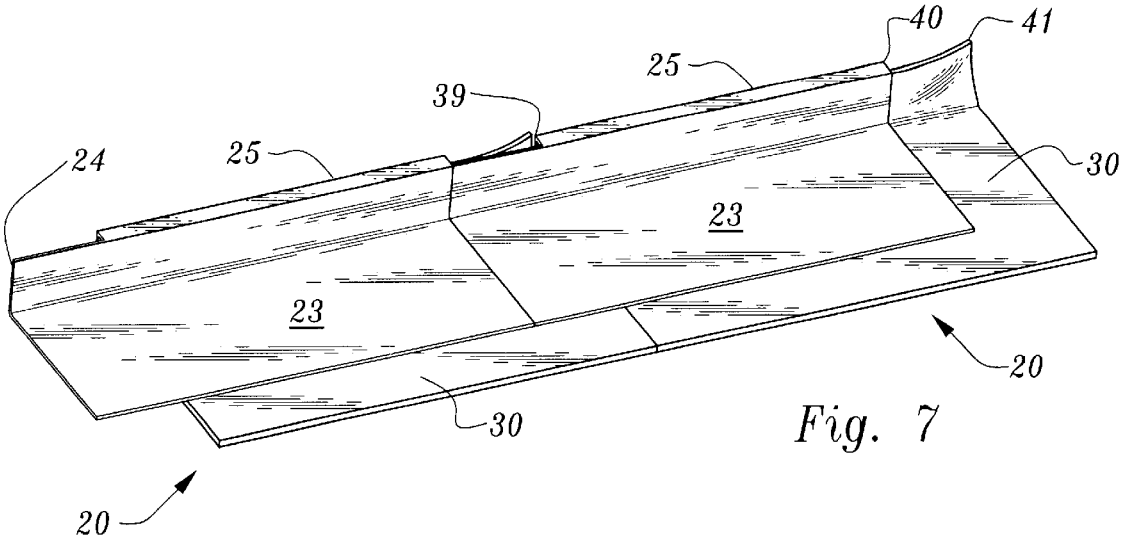
FIG. 7 is a bottom perspective view of two lengths of edging according to this invention, to illustrate how they would be overlapped, but not seen in an actual installation.

In FIGS. 6 and 7, the top and bottom perspective views of two sections of the invention, the overlapped placement of one strip of APR to the adjacent strip of APR is seen. Thus when two units are overlapped, the two bent sections 25 are in an abutted edge to edge relationship. It is to be understood, that while FIG. 7 is presented, in point of fact it is a virtual figure, as a person can never place him or herself in a physical position to actually view FIG. 7, as the units are nailed into position and are not available for such viewing.

Figure 8:
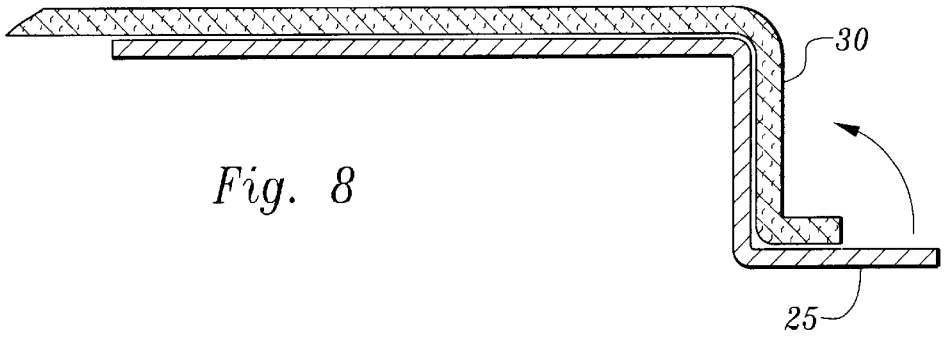
FIG. 8 is a sectional view depicting the manufacture of the edging device of this invention taken in midcycle.
Figure 9:
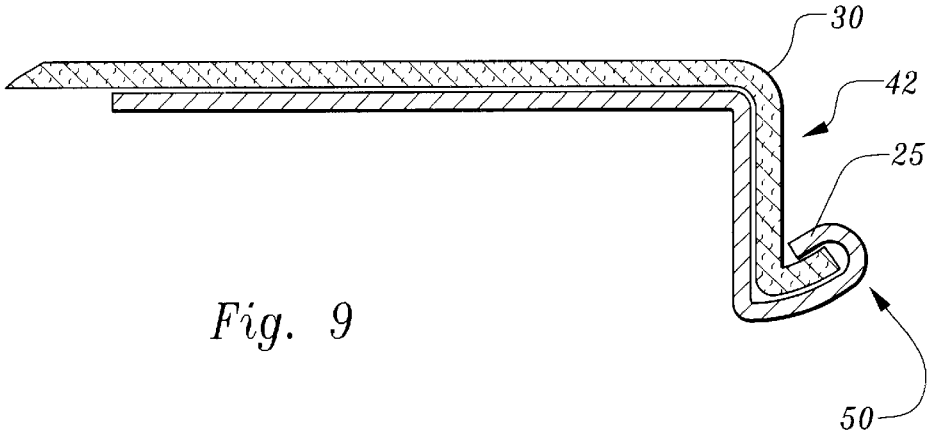
FIG. 9 shows the same edging at a later point in time upon the completion of construction of the device section.

FIGS. 8 and 9, which are sectional diagrammatic views at two points in time, relate to the formation of the bend 25 on the metal unit 22. In FIG. 8, the flange 25 which extends the entire length of the vertical section, but for a short finite distance, has been bent upwardly 90 degrees from the vertical. The short finite distance usually ranges from 4 to 6 inches in a 4 foot section of the edging. As will be explained, the short finite distance corresponds to the amount of overlay of one edging section upon another during installation.

The APR rubber, being a maleable product is shown also bent 90 degrees. Note that the extension of the flange 25 is set greater than the extension of the bent area of he APR 30. Then the metal in a continuous motion of course, is bent further around to overlay the APR on both its upper and its lower surfaces. Finally, at a still later point in time, the overlaid flange 25 is bent in the direction of arrow 42 back toward the vertical section 24 of the metal unit 22 to to form a wedge 50 (FIG. 9) to fully retain the APR in a floppy manner to the metal unit 22. The term floppy manner is employed because the balance of the APR sheet remains unattached until torched down.

Figures 10, 11:
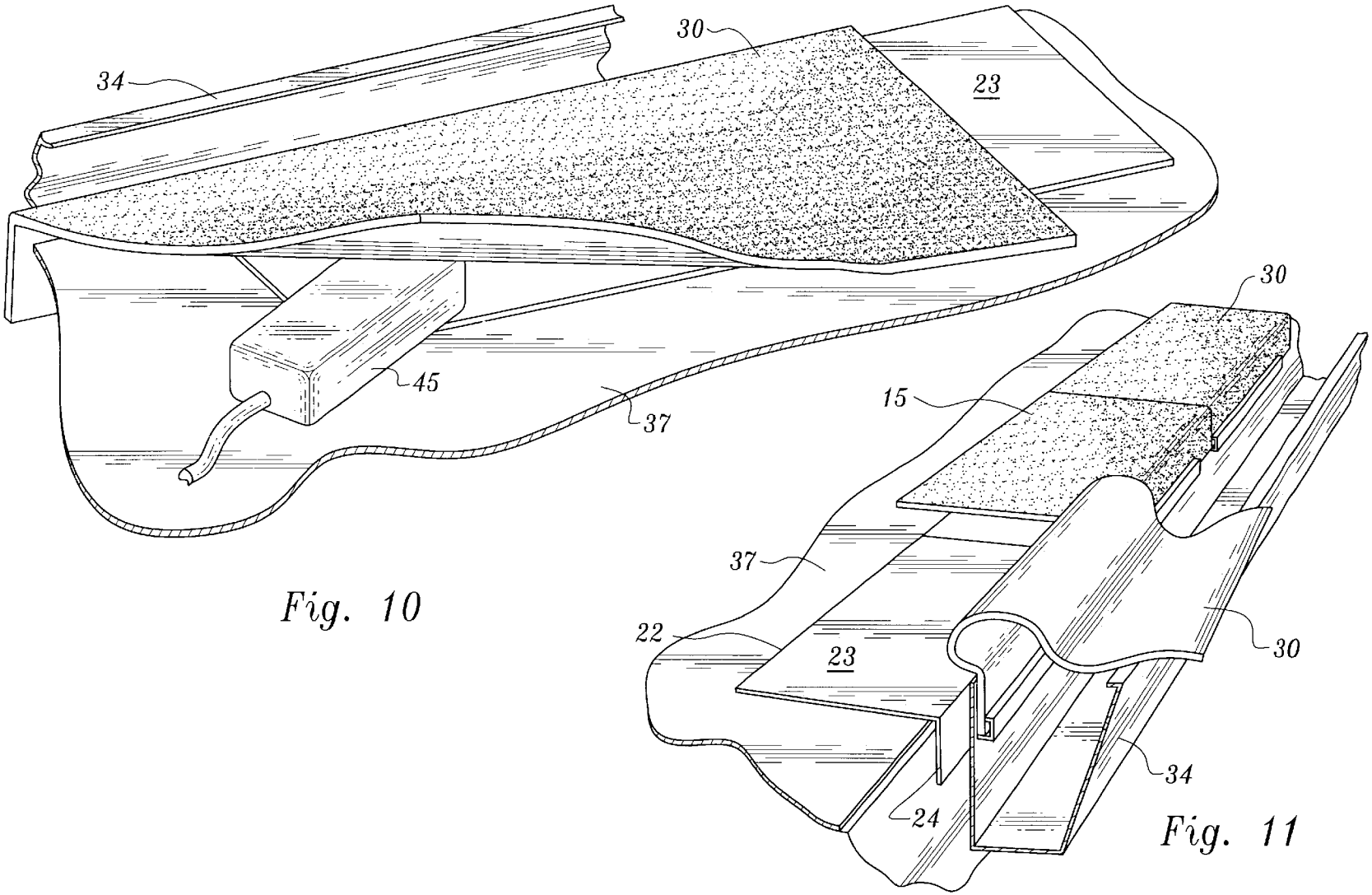
FIG. 10 is a perspective view showing the device of this invention being applied to a flat roof membrane.
FIG. 11 is a illustration showing several steps of the construction of a rood from the gutter and roof edging rearwardly.

FIG. 10 shows the presence of a heating unit 45 warming the metal unit's horizontal surface such that the APR will stick to it. Gutter 34 is also seen. The sheets of overlapped membrane 37 are also seen, as the cap sheet has not as yet been installed.

In FIG. 11, the metal unit 22 is seen with the floppily attached APR 30 ready for attachment to the horizontal surface 24 of the metal unit. Membrane layers 37 are seen and one cap sheet section 15 is shown having been applied into position. One should note how the APR is actually laying in the gutter 34.

Installation

As mentioned infra, the sections of finite length, preferably about 4 foot, of edging are installed with the APR only retained in the bend, by nailing through the metal member to the sub-roof. Length #1 is so installed as the first step. The next length of edging 20, length #2's non-overlapped area 47, that is, the laterally extending area that does not cover the metal unit of length #2, which non-overlapped area is denoted between the two arrows in FIG. 5 is overlaid onto the first installed length's uncovered metal area designated 48 in FIG. 6 whereby the area 47 while still unattached is now in position to be torched down, when the torching is carried out. When the area 47 is overlaid onto metal area 48, the two bends of the two lengths of edging will be in an abutting relationship. This procedure is carried out length of edging by length of edging along those edges of the roof where edging is to be installed.

In many instances due to the slope of the roof, or if a parapet is employed edging does not go all around the periphery of the building.

It is seen that the non-ponding edging-designated that way because the water can go over the edging into gutters is a significant improvement of the gravel stop edging previously employed.

Since more than likely the metal member of an edging unit 20 has not be pre-primed prior to the attachment of the APR to the bend, after all of the lengths are nailed into place, and the APR rotated 180 degrees out of the way, i.e., to be hanging down into the gutter if present, all of the metal is primed and left to dry over night. Then all of pieces of APR are torched onto the primed surface of the metal and the cap sheet applied as is known to the art.

Note also that metal such as galvanized steel is the most recommended material for the metal unit, a heavy duty plastic molded unit is also contemplated by this invention, either with or without nail holes.

It is seen that I have disclosed both a product and a process for manufacturing such a product that replaces the conventional gravel stop of flat roof buildings. A more esthetic appearance can be obtained as well as a safer one when optional water removing gutters are employed. Gutters can be utilized with conventional gravel stop.

Since certain changes may be made in the above described device without departing from the scope of the invention herein involved, it is intended that all matter contained in the above description and shown in the accompanying drawings shall be interpreted as illustrative and not in a limiting sense.

I claim:

1. In combination an inverted L-shaped metal unit having a horizontal section of greater depth than the elevation of the vertical section thereof, the vertical section also including a flange portion which extends the length of the vertical section, but for a short finite distance at one end of the vertical section, and a sheet of APR wedgedly connected along one edge thereof to said metal unit;

wherein the sheet of APR extends both rearwardly and laterally of the metal unit.

2. In the combination of claim 1 wherein the sheet of APR extends both rearwardly and laterally of the metal portion.

3. The process of forming a roof edging for installation as by nailing, which process comprises:

(A) forming an inverted L shaped unit having a horizontal section of greater depth than the elevation of the vertical section, and a flange portion depending from the vertical section the entire length thereof, save for a short finite distance, (B) overlaying a sheet of APR onto the inverted L unit, (C) bending the APR downwardly along and beyond the vertical section, (D) folding the flange portion upward and over the APR to form a wedge to retain the APR.

4. The process of installing a new roof which comprises:

(A) installing over a sub roof having a membrane thereon, an edging comprising a inverted L-shaped member having a terminal wedge retaining a sheet of APR, (B) torching down the APR to the L-shape member, later in time during the roofing process, torching the balance of the APR down to retain it in place.

5. The process of claim 4 including the further step of priming the metal unit prior to the torching step.

6. The process of claim 4 including applying Cap sheet over the edging and torching it down.

7. An edging for use on flat roof buildings, which edging unit comprises an inverted L-shaped metal portion, which metal portion has a horizontal section and a vertical section, the vertical section having a flange depending therefrom, wherein the vertical section and horizontal sections are equal in lateral extension, but the depth of the horizontal section is greater than the elevation of the vertical section;

the said flange extending laterally a finite distance less than the lateral extension of the vertical section, and being adapted to be bent upwardly;

a sheet of APR being attached to said flange by a bending of the flange up and over the APR to form a wedge to retain the edge of the APR layer sheet, such that the balance of the APR overlays the said metal portion.

8. The device of claim 7 wherein the lateral extension of the flange is about four inches less than the lateral extension of the vertical section of the metal portion.

9. In the device of claim 8 wherein the APR extends rearwardly from two to about four inches beyond the metal portion's depth, and the APR extends laterally beyond the flange to which it is affixed such as to in part overlie the metal portion to which it is affixed, an amount equal to the lateral extension of the flange free length of the vertical section.

10. An arrangement comprising at least two of the devices of claim 9 laterally abutting relationship of their metal portion's vertical sections with a flange free area between adjacent flanges, wherein the laterally extending area of APR from the first of said at least two devices overlaps the flange free area of the second of the at least two devices, and the APR of said first of said at least two devices overlays in part the metal portion of the second of said at least two devices.

* * * * *